United States Patent [19]

Di Nunzio

[11] 4,140,084

[45] Feb. 20, 1979

[54] PROCESS AND APPARATUS FOR THE STABILIZATION OF THE PERIOD OF OPENING OF ELECTROMAGNETIC FUEL INJECTOR

[75] Inventor: Vittorio Di Nunzio, Turin, Italy

[73] Assignee: Fiat Societa per Azioni, Turin, Italy

[21] Appl. No.: 743,023

[22] Filed: Nov. 18, 1976

[30] Foreign Application Priority Data

Dec. 9, 1975 [IT] Italy ..... 70010 A/75

[51] Int. Cl.[2] ..... F02B 3/00; G05F 1/44; F02M 51/00

[52] U.S. Cl. ..... 123/32 EF; 123/32 EA; 123/119 EC; 323/19

[58] Field of Search ..... 123/32 EF, 32 EA, 119 EC; 235/150.21; 323/19, 4

[56] References Cited

U.S. PATENT DOCUMENTS

| | | | |
|---|---|---|---|
| 3,483,851 | 12/1969 | Reichardt | 123/32 EA |
| 3,763,720 | 10/1973 | Aono et al. | 123/32 EA |
| 3,858,561 | 1/1975 | Aono | 132/32 EA |
| 3,897,762 | 8/1975 | Jones et al. | 123/32 EA |
| 3,965,410 | 6/1976 | Roselle et al. | 323/19 |
| 3,978,391 | 8/1976 | Migeon et al. | 323/4 |
| 4,040,397 | 8/1977 | Leichle | 123/32 EA |

*Primary Examiner*—Charles J. Myhre
*Assistant Examiner*—P. S. Lall
*Attorney, Agent, or Firm*—Sughrue, Rothwell, Mion, Zinn and Macpeak

[57] ABSTRACT

The period of opening of a solenoid-operated fuel injector is stabilized against variation of vehicle battery voltage by computing the period of injector opening from the instant of a discontinuity present in each rise of the solenoid energizing current. The discontinuity is detected and differentiated to form one input to a comparator, the other input of which is supplemented from the vehicle battery through a Zener diode so that the comparison threshold of the comparator increases as the battery voltage increases. The comparator is automatically switched off in the absence of a solenoid energizing current.

7 Claims, 14 Drawing Figures i
c
t

V
t i
t

X
t q
t
A
B
C
D
G
E
F

V
t i
t x
t q
t
A
B
C
D
G
E
F

V
t i
A'
B'
t

V(-)
V(+)
t

V
t

PROCESS AND APPARATUS FOR THE STABILIZATION OF THE PERIOD OF OPENING OF ELECTROMAGNETIC FUEL INJECTOR

BACKGROUND OF THE INVENTION

The present invention relates to a process for the stabilization of the period of opening of electromagnetic injectors in a fuel injection system, particularly for engines of motor vehicles, such that the quantity of fuel injected is, for a given injector opening period, independent of the vehicle battery voltage. The invention also relates to a device for carrying out this process.

This invention relates in particular to a fuel injector of the electromagnetic type having a spring-loaded obturator piston movable by means of an operating solenoid, energization of which is controlled by electrical command signals of variable duration which keep the injector open for the required open time. For given conditions in the electrical circuit controlling the operating solenoid and the hydraulic fuel feeding circuit associated with the injector, the quantity of fuel injected at each injector stroke is directly proportional to the open time of the injector.

It is known that from the electrical standpoint the operating solenoid of an electromagnetic injector is equivalent to an inductance and a resistance in series. Upon energization of the solenoid the energizing current in the solenoid rises exponentially with a certain time constant, the instantaneous value of the current being directly proportional to the supply voltage, that is, the vehicle battery voltage.

The magnetic force opposing the preloading of the spring and acting on the obturator piston of the injector upon energization of the operating solenoid increases with the exponential growth of the energizing current and consequently movement of the piston commences only after a certain period of time following the moment of energization of the operating solenoid. Furthermore, upon de-energization of the operating solenoid there is a delay in the closing of the injector due to phenomena of magnetic hystersis and to the delay in the decay of the magnetic flux in the operating solenoid after switch-off of the energizing current.

It is known from the copending U.S. Pat. Application No. 736,684 that it is possible to compensate this lag between the command signals for opening and closure of an injector and the actual times of opening and closure of the injector if it is assumed that the moment of actual opening is the intersection of an experimentally predetermined threshold with the characteristic growth curve of the energizing current of the injector operating solenoid. According to that method, a counter which controls the duration on an injector control pulse is permitted to run during the battery voltage dependent lag time between the end of each injection control pulse and the time at which the injector actually closes. The counter begins running at the actual opening of the injector in the next injection cycle so that the battery voltage dependent lag time is always subtracted from the desired duration of the injection control pulse. This will result in an accurate elimination of both the battery voltage dependent decay time and the battery voltage dependent rise time of the injector energizing current only if the actual opening and closing times of the solenoid can be accurately determined.

The method described in the said U.S. Patent Application No. 736,684, which derives information from the waveform of the energizing current and, therefore, from the force applied to the injector obturator piston, presupposes that, for a given force on the piston there is always a corresponding mechanical movement which is always the same for an individual injector or for the various injectors in an injection system provided on a motor vehicle. Thus, it can always be assumed that an injector will open and close at experimentally determined values of the solenoid energizing current. This assumption requires a very accurate calibration of the injectors both with regard to their piston stroke and their spring preloading so as to ensure that, for a given energization current, the through-flow of the various injectors is uniform and such as to ensure constancy and repeatability in the movement of the injector obturator pistons as a function of time.

SUMMARY OF THE INVENTION

The object of the present invention is to provide a process for correction of the open time of an injector in a fuel injection system and a device for carrying out this process so as to obviate the necessity for the abovementioned accurate calibration. A further object of the invention is to provide an injector control device of simple manufacture and low cost.

According to the invention there is provided a process for the correction of the period of opening of an electromagnetic injector in a fuel injection system particularly for motor vehicles, such that the quantity of fuel injected is, for a given commanded injector opening period, independent of vehicle battery voltage, in which use is made of the characteristic variation with time of the injector energizing current, characterised in that the duration of the period of opening of the injector is computed as from the instant of a discontinuity systematically present in the rise of the energizing current of the injector.

In the process according to the present invention, it is assumed that the fuel injected between the commencement of the injection control pulse and the time at which the injector becomes fully opened is inversely proportional to battery voltage, and that the fuel injected between the termination of the injection control pulse and the complete decay of the energizing current is directly proportional to battery voltage. The variations with battery voltage of these fuel quantities are thus considered to cancel one another. Thus, if the measurement of the injector opening period is limited to the time between the complete opening of the injector or solenoid and the termination of the injection control pulse, a known quantity of fuel will be injected for any given computed injector open period.

BRIEF DESCRIPTION OF THE DRAWINGS

The invention will be further understood from the following description, given by way of non-limiting example, with reference to the accompanying drawings, in which.

Figure 14:
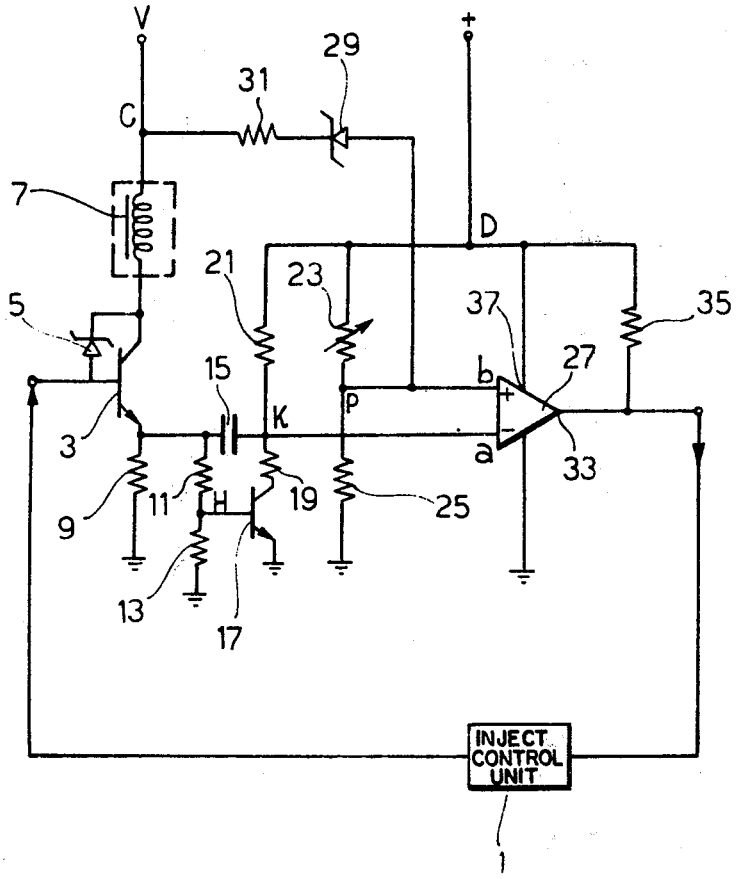
FIG. 14 is a circuit diagram of a device for carrying out the process according to the invention.

Referring first to FIG. 14, an injection control unit 1, shown schematically, provides an output which is applied to the base of a transistor 3 and to the anode of a Zener diode 5. The cathode of the said Zener diode 5 is connected to the collector of the transistor 3 and to one end of an operating solenoid 7 of an injector, the other end of the solenoid 7 being connected to a supply voltage V provided by the vehicle battery. The emitter of the transistor 3 is connected to one end of a resistor 9, the other end of which is earthed, and to a resistor 11 in series with a resistor 13 which is in turn earthed. The emitter of the transistor 3 is also connected to a capacitor 15. The junction point H between the resistors 11 and 13 is connected to the base of a transistor 17 the emitter of which is earthed and the collector of which is connected to a resistor 19 in series with a resistor 21. The junction point K between the resistors 19 and 20 is connected to the opposite side of the capacitor 15 from the transistor 3. A variable calibration resistor 23 in series with a resistor 25 is connected in parallel with the resistor 21, the resistor 25 being earthed. The junction point K is connected to a first input a of a comparator 27 having a second input b connected to the junction point P between the resistors 23 and 25. The comparator 27 may, for example, comprise an operational amplifier. The point P is also connected to a Zener diode 29 connected through a resistor 31 to a point C connected to the motor vehicle battery. The output 33 of the comparator 27 is connected to the control unit 1 and through a resistor 35 to a point D which is common to the resistors 21 and 23. A third input 37 of the comparator 27 is also connected to the point D, which is referred to a fixed positive bias voltage.

Figures 1, 2, 3, 4, 5:
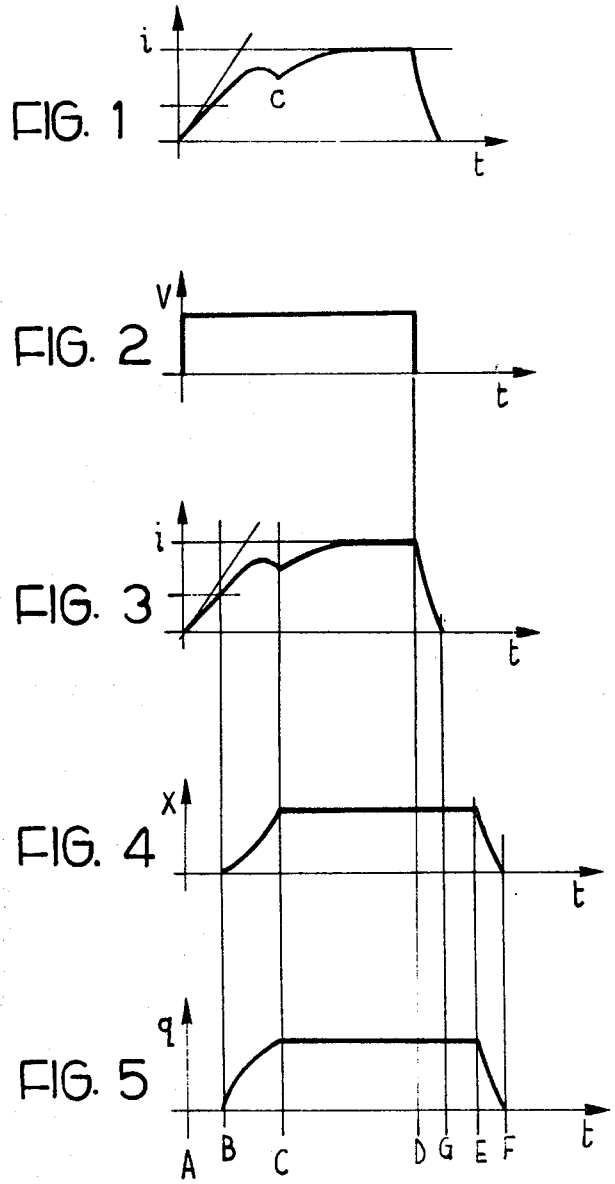
FIG. 1 represents the variation with time t of the energizing current of an injector operating solenoid.
FIGS. 2 to 5, respectively, represent the variation with time t of: the input voltage V; the energizing current i; the travel X of the injector obturator piston, and the fuel through-flow q of the injector.

Measurement of the variation with time of the energizing current of an injector operating solenoid yields a result as shown graphically in FIG. 1, with a discontinuity C in each current rise at the time corresponding to the instant the movable part of the injector, that is, the obturator piston, strikes against a fixed part of the injector at the end of its opening stroke. On the other hand, the injector closing lag previously mentioned can be kept independent of the battery voltage provided that the decay of the energizing current can be made as fast as possible. Fast decay of the solenoid current is achieved by the Zener diode 5 connected between the base and collector of the transistor 3 and having a sufficiently high breakdown voltage that it absorbs the electromagnetic energy stored in the solenoid inductance.

In the process according to the invention it is considered that the opening of the injector occurs instantaneously at the discontinuity point C of the current /time characteristic, resulting in an instantaneous increase in fuel flow through the injector from zero to maximum flow at the instant of impact of the obturator piston against the fixed part of the injector upon opening of the latter.

The differentiating network constituted by the capacitor 15 and resistors 11, 13 detects the discontinuity C in the waveform of the energizing current making it possible to determine the moment when the injector actually opens; The injection period, that is, the injector open time, is computed as from this moment.

Figures 6, 7, 8, 9:
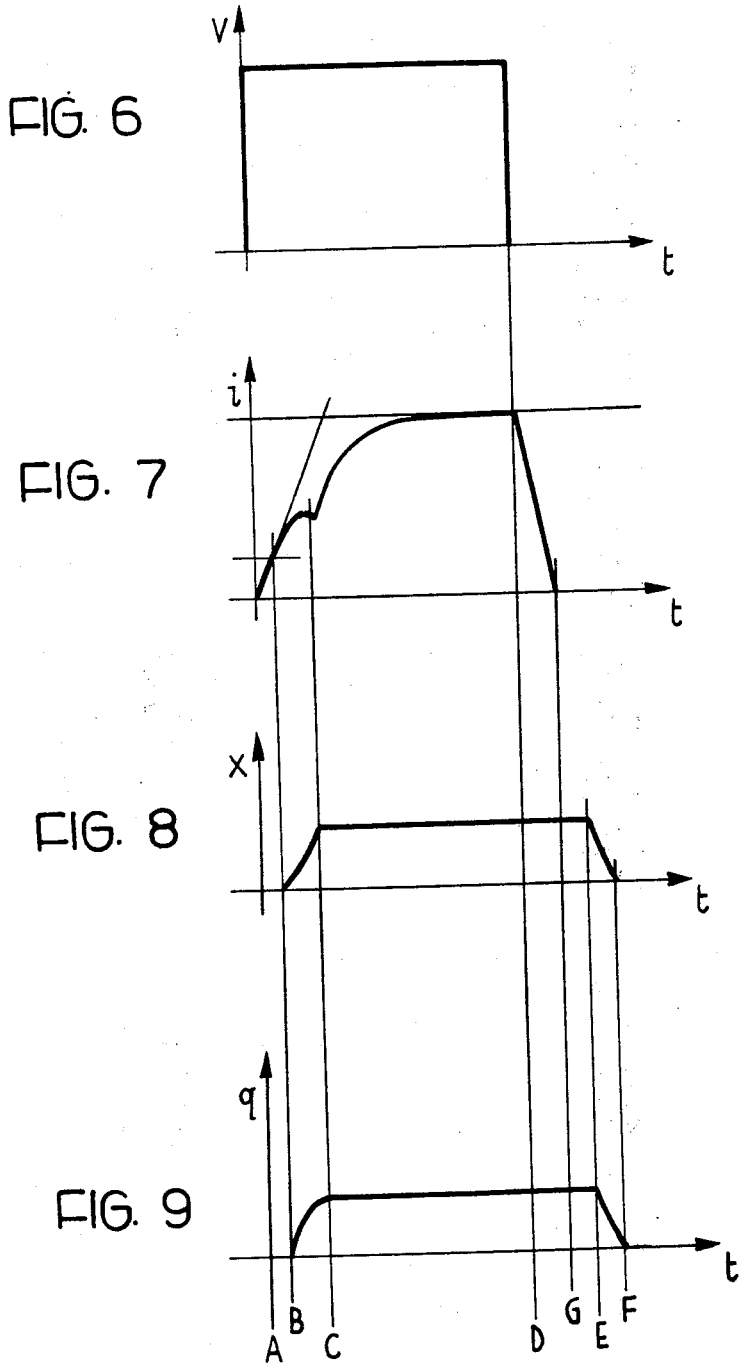
FIGS. 6 to 9 represent the same parameters as FIGS. 2 to 5, respectively, but with a higher battery voltage.

Referring now to FIGS. 2 to 9, it will be supposed that the variation of the fuel flow q through the injector is that indicated in FIGS. 5 and 9 at two different battery voltages. The quantity of fuel injected in one injection period can be broken down into first parts which are constant and independent of variation of the battery voltage, corresponding to the time intervals CD and GE due to parasitic currents and GF due to inertial lag, a second part which corresponds to increasing fuel flow upon opening of the injector (time BC) and a third part corresponding to the decay of the current in the operating solenoid (time DG). The last two time intervals BC and DG vary when the battery voltage varies (compare FIGS 5 and 9): the time BC decreases when the battery voltage increases, on account of the increased speed of movement of the obturator piston, while the time DG increases when the battery voltage increases, either because the initial value of the solenoid current is greater, or because the gradient of the current decay is smaller. This can readily be verified by solving the equations relating to the injector control circuit containing the Zener diode for the rapid decay of the current. Therefore the quantities of fuel injected during the two time intervals BC and DG vary in opposite senses in response to battery voltage variation. These two variations cancel each other out to a first approximation.

The operation of the device which carries out the process according to the invention will be described with reference to FIG. 14. A Wheatstone bridge is formed by the resistors 19, 21, 23, 25 connected between the battery voltage at the point D and earth. A first reference or threshold voltage V− is established at point K, that is, at the first comparator input a and a second reference or threshold voltage V+ is established at point P, that is, at the second comparator input b. The values of the resistors 19, 21, 23 and 25 of the bridge are such that, in the absence of current in the injector operating solenoid 7 the value of the threshold voltage V− exceeds the value of the threshold voltage V+ and under these conditions the signal V− is constituted by the rest value of the bias voltage of the bridge, so that the output signal given by the comparison in the comparator 27 between V− and V+ is of low level.

Figures 10, 11, 12, 13:
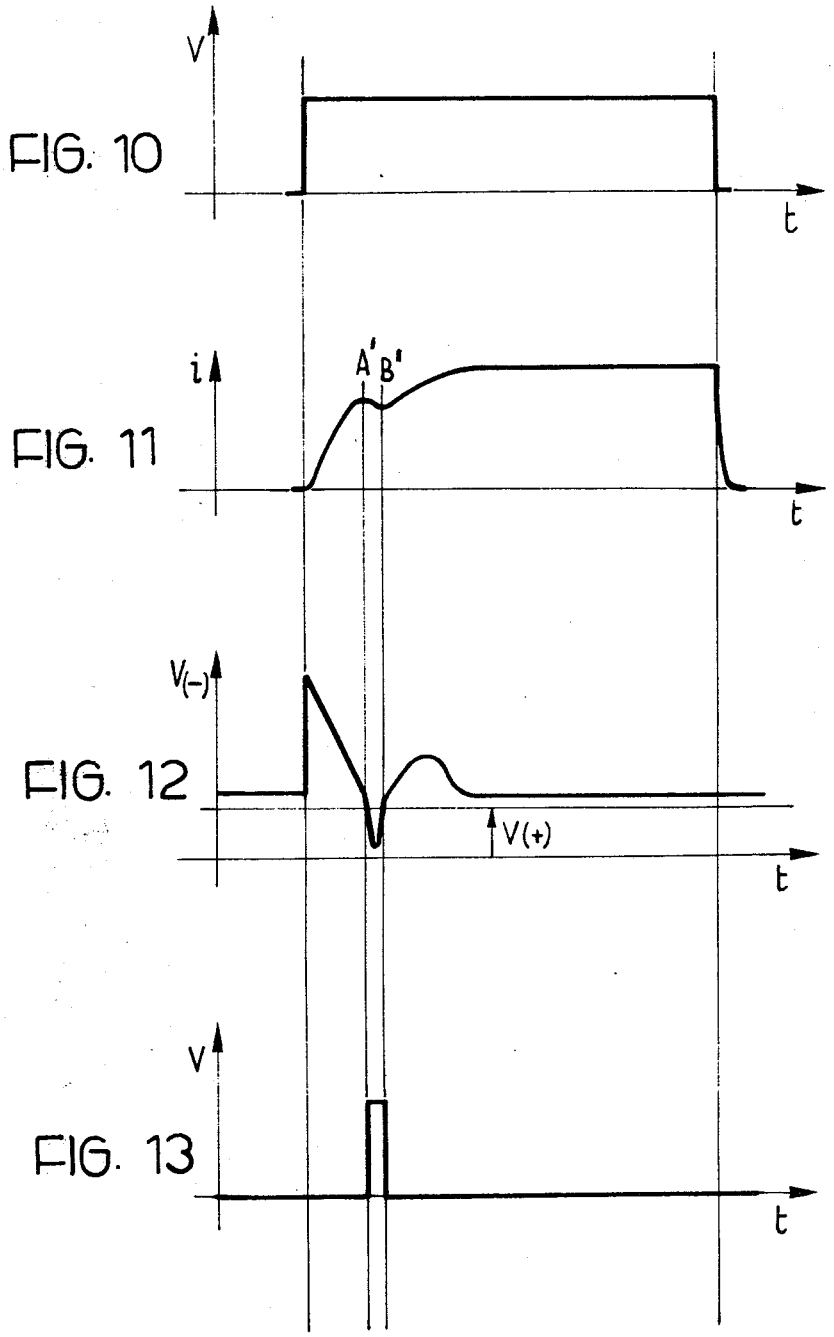
FIG. 10 represents the variation with time t of the battery voltage V upon energization of an injector.
FIG. 11 represents the variation with time t of the solenoid energizing current i, showing points of discontinuity A' and B' which must be accurately detected and with the trailing edge of the energizing pulse made as steep as possible to avoid delays due to the previously mentioned phenomena of magnetic hysteresis.
FIG. 12 represents the variation with time of one comparator input voltage V− with the discontinuity of FIG. 11 amplified and indicating a comparison threshold V+.
FIG. 13 represents the waveform with respect to time of the voltage pulse at the output of the device according to the invention.

When the injector operating solenoid 7 is energized by an injection control pulse from control unit 1, a voltage is superimposed on the point K, this voltage passing through the high-pass filter formed by the capacitor 15 and the equivalent resistance of the Wheatstone bridge 19, 21, 23, 25 as seen from the point K, so that to a first approximation the derivative of the energizing current is obtained. This bridge is consequently unbalanced and provides a pulse V− at comparator input a as shown in FIG. 12. However, the resistance-capacitance network transfers not only the derivative of the signal relating to the movement of the injector but also the derivative of the rise of the energizing current. The useful part of the voltage signal V− at the comparator input a, that is, the part which crosses the threshold V+ on the other comparator input b and which corresponds to the discontinuity C in the energizing current, moves towards higher values as the battery voltage increases. To compensate for this the threshold V+ at the comparator input b is made to increase as the battery voltage increases by applying at the point P a second signal coupled to the battery through the Zener diode 29 and the resistor 31. The transistor 17 in series with the bridge resistor 19 is normally switched off, maintaining the output of the comparator 27 at zero over a range of battery voltages in the absence of an input differential signal corresponding to an injector energizing current at the comparator input. The transistor 17 becomes conductive as soon as a signal appears on the resistor 9, rendering the bridge 19, 21, 23, 25 operative. The first part of the differential input signal to the comparator (FIG. 12) is strongly positive and then rapidly decreases in correspondence with the discontinuity C in the movement of the injector obturator, at which point the signal crosses the threshold V+ (FIG. 12), causing the comparator 27 to provide an output pulse (13). The output pulse from the comparator 27, corresponding to the discontinuity C, is passed to the input of the control unit 1 to determine the start of the injection. The reception of the signal by the control unit 1 corresponds to a time C in FIG. 5 and the control unit 1 terminates the injection control pulse at time D in a known manner. Since the sum of the fuel injected prior to the complete opening of the injector and that injected after the termination of the injection control pulse is substantially independent of battery voltage, a known quantity of fuel will be injected for a given commanded open time CD. The variable cailbration resistor 23 of the bridge 19, 21, 23, 25 serves to determine experimentally once and for all the correct functioning of the equipment in the full range of operating temperatures (−40°−+85° C.) and throughout the range of battery voltages (6V–18V).

Further modifications and variations can be made in the device herein described and illustrated without departing from the scope of the invention.

I claim:

1. A process for stabilization of the period of opening of an electromagnetic injector in a fuel injection system, particularly for motor vehicles, such that the quantity of fuel injected is, for a given commanded injector opening period, independent of vehicle battery voltage, said process of the type in which the time at which a control unit begins computation of the injector open time is determined from the characteristic variation in time of the injector energizing current, comprising the steps of:

providing an injection control signal;

detecting a discontinuity systematically present in the rise of the energizing current of the injector;

generating a detection signal indicative of the ccurrence of said discontinuity; and providing said detection signal to said control unit, whereby said control unit begins computation of the injector open time with the reception of said detection signal.

2. Device for stabilization of the period of opening of an electromagnetic injector in a motor vehicle fuel injection system of the kind wherein each rise of the energizing current of the injector exhibits a systematic discontinuity, the device comprising:

fuel injection control means controlling the energization of the fuel injector, detector means for detecting said discontinuity, reference means generating first and second reference signals, comparator means for comparing the said first and second reference signals, to provide an output controlling the injection control means, means for superimposing on said first reference signal an output signal from said detector means, means acting on said reference means to cause the second reference signal to increase in response to increase in the battery voltage of the motor vehicle, and biassing means for maintaining the comparator means at zero output in the absence of an injector energizing current.

3. Device as claimed in claim 2, wherein said detector means comprise a transistor having a resistive emitter load.

4. Device as claimed in claim 2 wherein said reference means comprise a voltage divider of the Wheatstone bridge type.

5. Device as claimed in claim 2, wherein the said comparator means comprise an operational amplifier.

6. Device as claimed in claim 2, wherein said means for causing the second reference signal to increase upon increase of the vehicle battery voltage comprise a Zener diode and resistor connected in series between the battery voltage and the input of the comparator means to which said second reference signal is applied.

7. Device as claimed in claim 2, wherein the biassing means include a transistor connected to the reference means to render the latter operative only in the presence of an injector energizing current.

* * * * *